United States Patent [19]

Kim

[11] Patent Number: 5,038,020

[45] Date of Patent: Aug. 6, 1991

[54] CIRCUIT FOR CONTROLLING THE OUTPUT OF AN ELECTRONIC COOKING SYSTEM

[75] Inventor: Hyo S. Kim, Chollabuk-do, Rep. of Korea

[73] Assignee: Samsung Electronics Co., Inc., Kyonggi-do, Rep. of Korea

[21] Appl. No.: 366,888

[22] Filed: Jun. 15, 1989

[30] Foreign Application Priority Data

Jun. 17, 1988 [KR] Rep. of Korea ..... 1988-9297

[51] Int. Cl.[5] ..... H05B 1/02

[52] U.S. Cl. ..... 219/501; 219/497; 219/494; 219/506

[58] Field of Search ..... 219/501, 492, 493, 497, 219/499, 505, 506, 508, 10.55 B

[56] References Cited

U.S. PATENT DOCUMENTS 4,443,690 4/1984 Payne et al. ..... 219/506

4,453,068 6/1984 Tucker ..... 219/70.77

4,467,184 8/1984 Loessel ..... 219/506

4,585,926 4/1986 Easthill ..... 219/506

4,769,657 9/1988 Takahashi ..... 219/506

*Primary Examiner*—Mark H. Paschall

*Attorney, Agent, or Firm*—Stern, Kessler, Goldstein & Fox

[57] ABSTRACT

There is disclosed a circuit for controlling the operation of an electronic cooking system. The circuit comprises a counting inverter for controlling the operation of heating coil, and a pulse generator. The counting inverter comprises a counter for counting the pulses outputted from a microcomputer to deliver a signal for establishing the output of the heating coil and to deliver the output signal of an abnormal state detection circuit to the microcomputer. The pulse generator is disposed between the microcomputer and the counting inverter to synchronize and clear the counter with the output signal of the microcomputer.

16 Claims, 2 Drawing Sheets

CIRCUIT FOR CONTROLLING THE OUTPUT OF AN ELECTRONIC COOKING SYSTEM

TECHNICAL BACKGROUND

The present invention concerns a circuit for controlling the output of an electronic cooking system, and more particularly, a circuit for establishing the output of a four-bunner electronic cooking system, controlling the operation, and detecting the abnormal state by using a microcomputer.

The output of a conventional four-bunner electronic cooking system is established only by time splitting or frequency controlling, so that the output voltage is established by means of the signal of each output terminal of a microcomputer and a microcomputer having a number of terminals is used. In addition, numbers of conducting lines are required for information transferring between the microcomputer and an inverter, so that the circuit is complicated and imperfect connections occur due to numerous connecting points. Moreover, the number of component parts is increased, thereby increasing the manufacturing cost.

SUMMARY OF THE INVENTION

The object of the present invention is to provide a circuit for controlling the output of an electronic cooking system wherein the signals suppled by two output terminals of a microcomputer control in multi-steps the power supplied to the heating means so as to establish the output of the electronic cooking system, and the signal indicating abnormal state is sensed to control the operation of the heating means.

According to the present invention, a circuit for controlling the operation of said electronic cooking system comprises a counting inverter for controlling the operation of the heating means, said counting inverter comprising a counter for counting the pulses outputted from a microcomputer to deliver a signal for establishing the output of said heating means and to deliver the output signal of an abnormal state detection circuit to said microcomputer, and a pulse generating means disposed between said microcomputer and said counting inverter to synchronize and clear said counter with the output signal of said microcomputer.

BRIEF DESCRIPTION OF THE ATTACHED DRAWINGS

FIG. 1 is a block circuit diagram of an elctronic cooking system according to the present invention; and FIG. 2 is a circuit for controlling the output of the first heating means in FIG. 1.

DETAILED DESCRIPTION OF THE PREFERRED EMBODIMENT

The present invention will now be described more specifically with reference to the drawings attached only by way of example.

An electronic cooking system comprises a microcomputer 1 for generating programmed control signals and heating means 2 for heating foodstuff. Circuits 5, 6, 7, 8 for controlling the output of each heating means comprise a counting inverter 3 for controlling the operation of the heating means, and a pulse generating means 4 for controlling information transferred between the microcomputer 1 and the counting inverter 3. The counting inverter 3 counts the pulses outputted from the microcomputer 1 to deliver a signal for establishing the output of the heating means 2 and to detect the abnormal state of the heating means 2.

Figure 1:
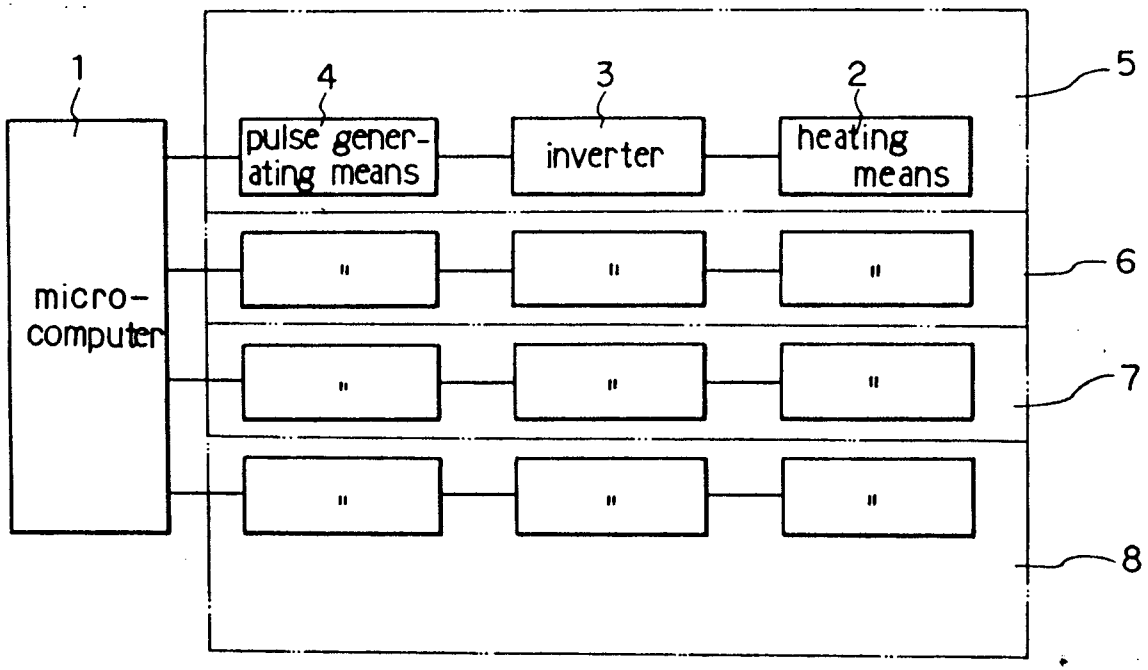
Figure 2:
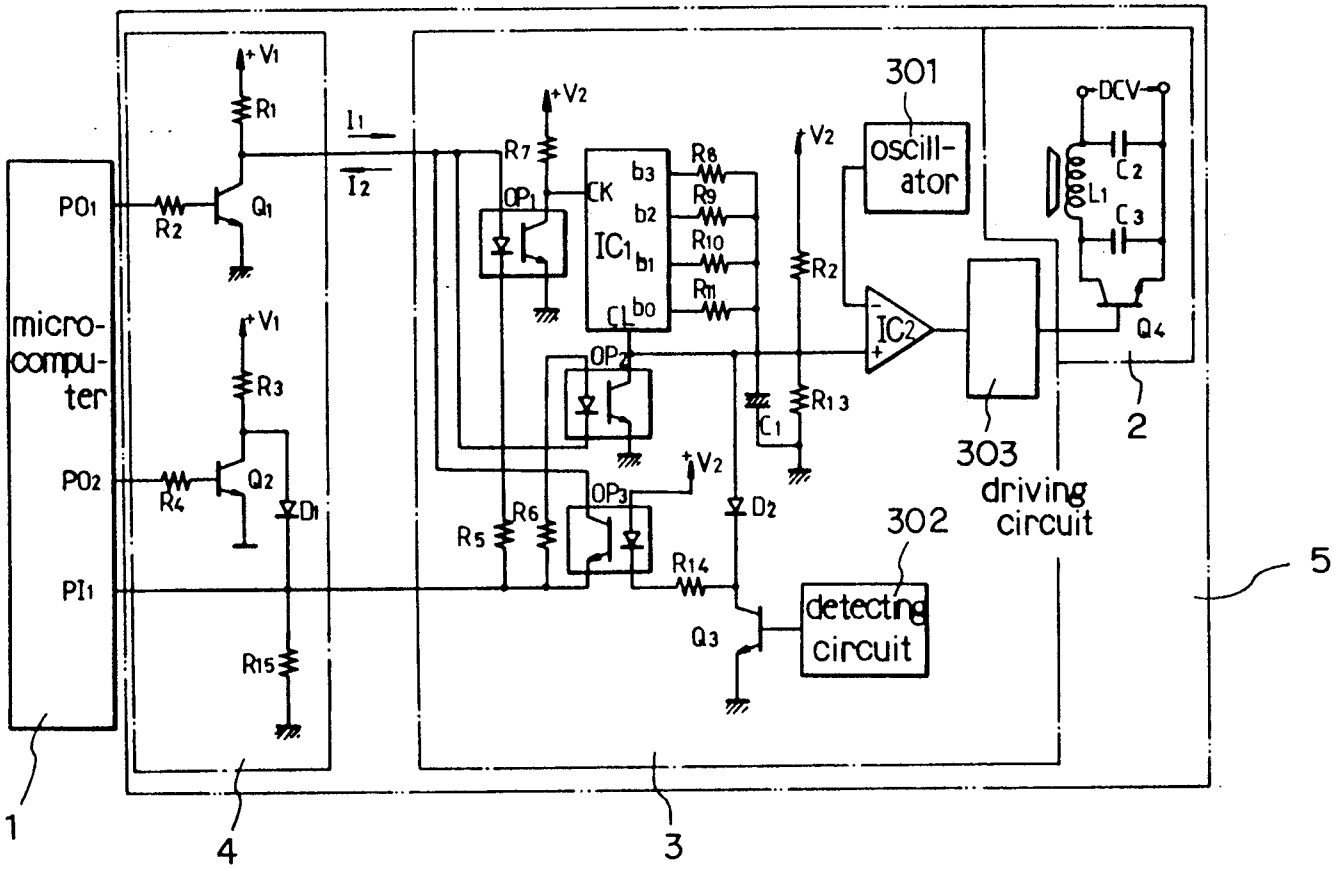

Referring to FIG. 2 which illustrates circuit 5 for controlling the output of the first heating means in FIG. 1, the present invention comprises the microcomputer 1 for generating programmed control signals, heating means 2 for generating energization of control signals having induction heating coil L1, condensers C2, C3 and transistor Q4, the counting inverter 3, and the pulse generating means 4. The counting inverter 3 comprises opto-couplers OP1–OP3, resistors R5–R14, counter IC1, transistor Q3, diode D2, condenser C1, comparator IC2, saw tooth wave oscillating circuit 301, conventional abnormal state detecting circuit 302, and conventional heating means driving circuit 303. The pulse generating means comprises transistors Q1,Q2, diode D1, and resistors R1–R4, R15.

The operation of the present invention may be divided into the three states of establishing the output of the heating means 2, detecting the abnormal state and blocking the operation of the system, which will be described with reference to FIG. 2.

The output of the heating means 2 is established by providing clock signal to the counter IC1 of the counting inverter 3 so as to adjust the voltage outputted to the noninverting terminal of the comparator IC2. Here, if the output terminal PO1 of the microcomputer1 is made to have the low level voltage, and the other output terminal PO2 the high level voltage, the transistor Q1 becomes turned off, and the other transistor Q2 turned on. Hence, current I1 flows through resistor R1 of pulse generating means 4, light emitting element of opto-coupler OP1 in counting inverter 3, resistor R5 and another resistor R15 of pulse generating means 4, thereby the opto-coupler OP1 being turned on.

Accordingly, the clock signal is applied to the clock terminal CK of counter IC1, and therefore, output terminal bO becomes to have high level voltage, so that the divided voltage by resistors R11–R13

$$V = \frac{\dfrac{1}{\dfrac{1}{R8} + \dfrac{1}{R9} + \dfrac{1}{R10} + \dfrac{1}{R13}}}{\dfrac{1}{\dfrac{1}{R11} + \dfrac{1}{R12}} + \dfrac{1}{\dfrac{1}{R8} + \dfrac{1}{R9} + \dfrac{1}{R10} + \dfrac{1}{R13}}} \times V_2$$

(Where V2 is source voltage which is applied to opto-coupler) is applied to the non-inverting terminal of comparator IC2, thereby being compared with the saw tooth wave applied to the inverting terminal of the comparator IC2 from the saw tooth wave oscillating circuit 301. Thus, the signal for establishing the output is delivered through the heating means driving circuit 303 to the heating means so that the induction heating coil L1 is properly heated according to the signal.

When the signal one step higher than the above signal for establishing the output is to be delivered, the output terminal PO1 of microcomputer 1 is made to have the high level voltage, and then again the low level voltage. Consequently, the opto-coupler OP1 of the counting inverter 3 becomes turned off, and then, turned on, so that the clock signal is applied again to the clock terminal CK of the counter IC1, and then the next output terminal b1 becomes to have the high level voltage. Accordingly, the divided voltage by resistors R10, R12, R13 is applied to the non-inverting terminal of comparator IC2, thereby being compared with the saw tooth wave applied to the inverting terminal of the comparator IC2, so that the signal for establishing the output is applied through the heating means driving circuit 303 to the heating means 2, thereby heating the foodstuff.

Here, the resistors R8–R11 at each output terminal of the said counter IC1 should satisfy the relationship of 2R8≦R9, 2R9≦R10, 2R10≦R11.

The counter IC1 counts the pulses generated as the output terminal PO1 is repeatedly made to have the high level voltage starting from the low level with the other output terminal PO2 having the high level voltage, whereby the signal for establishing the output is delivered to the heating means 2. When the output of the heating means 2 is to be lowered, clearing signal is applied to the clear terminal CL of the counter IC1, and thereafter, the clock signal is again applied to the clock terminal CK of counter IC1 according to the output to establish.

On the other hand, when detecting the abnormal state, the signal detected by the abnormal state detecting circuit 302, namely, the signal generated when there is no container on the heating plate not shown in the drawings, unsuitable container is placed on the plate, or the container is overheated, is applied to the input terminal PI1 of the microcomputer 1 which properly controls the heating means.

For example, while the heating means 2 is being operated, if the current I1 flows through resistor R1, the light emitting element of opto-coupler OP1, resistor R5 and another resistor R15, the voltage dropped through the resistor R15 is applied to the input terminal PI1 of the microcomputer 1. If the applied voltage is higher than the reference value established into the microcomputer 1, it represents the abnormal state, or otherwise the normal state.

In the abnormal state, the signal produced from the abnormal state detecting circuit 302 turns on the transistor Q3 so that the voltage applied to the non-inverting terminal of the comparator IC2 is dropped into the low level through diode D2 and transistor Q3 while current flows through the light emitting element of the opto-coupler OP3, resistor R14, and transistor Q3 so as to turn on the opto-coupler OP3. Hence, the voltage drop between the resistors R1 and R15 of the pulse generating means 4 becomes almost zero, thereby increasing the voltage drop by the resistor R15.

At this time, as the voltage dropped through the resistor R15 is supplied to the input terminal PI1 of the microcomputer 1, the microcomputer 1 operates the display not shown in the drawings as well as cuts off the heating means 2.

When the heating means 2 is cut off, the output terminal PO1 of the microcomputer 1 becomes to have the high level voltage and the other output terminal PO2 the low level voltage, whereby the transistor Q1 is turned on and the other transistor Q2 is turned off. Hence, current I2 flows through resistor R3 of the pulse generating means4, diode D1, resistor R6 of counting inverter 3 and the light emitting element of opto-coupler OP2 to the transistor Q1 of the pulse generating means 4 so that the opto-coupler OP2 is turned on.

In this case, the clear signal is applied to the clear terminal CL of counter IC1, so that the voltage applied to the non-inverting terminal of the comparator IC2 which supplies the signal for establishing the output through the heating means driving circuit 303 to the heating means 2 becomes zero, thereby the output of the comparator IC2 being maintained in the low state so as to cut off the operation of the heating means.

As described above, the present invention uses fewer terminals of the microcomputer than the conventional electronic cooking system, so that the number of the conduction lines for information transferring between the pulse generating means4 and the inverter 3 is minimized, and simple circuit construction suffices the output establishment, operational controlling, and detection of the abnormal state of the heating means 2.

What is claimed is:

1. A circuit in an electronic cooking system for controlling the output supplied to a heater by signals provided from the two output terminals of a microcomputer, the circuit comprising:

counting means for counting signals outputted from said microcomputer and for outputting a voltage based upon a count of said signals;

comparator means coupled to said counting means for comparing the voltage from said counting means with a sawtooth wave from a sawtooth oscillator; and driving means coupled to said comparator means for driving said heater according to the output of said comparator means.

2. A circuit of claim 1, wherein said counting means includes a first opto-coupler for generating a synchronizing signal to a clock terminal of said counting means, and a second opto-coupler for generating a clearing pulse to a clear terminal of said counting means, said synchronizing signal and said clearing pulse being generated by the output of a pulse generating means for receiving signals from said microprocessor.

3. A circuit of claim 1, wherein the output of said counting means is coupled to a voltage divider composed of a plurality of resistors.

4. A circuit of claim 1, further comprising an opto-coupler for providing said microcomputer with a signal for controlling the operation of said driving means according to the output of an abnormal state detecting circuit.

5. A circuit of claim 1, wherein said heater includes a coil.

6. A circuit of claim 5, wherein said driving means comprises a direct current power source connected in series to said coil and a transistor, said direct current power source transferring energy under the control of said transistor, said transistor controlled by said driving means.

7. An electronic cooking system for heating foodstuff, comprising:

(a) a microcomputer for providing pulses;

(b) a heating means for applying a direct current voltage to a heating coil;

(c) a driving circuit for controlling said heating means;

(d) a counting invertor having a counter and a comparator, said counter for counting said pulses and for providing a voltage output at a voltage level corresponding to the desired heating output of said heating coil, said comparator for comparing said voltage output and a sawtooth wave from an oscillator and for providing a pulsed output to said driving circuit; and (e) a pulse generating means disposed between said microcomputer and said counting invertor for synchronizing said counter and said microcomputer.

8. The system of claim 7, wherein said counting invertor further comprises an abnormal state detection circuit adapted to terminate said voltage output upon detection of an abnormal state of said heating means and to inform said microcomputer of said abnormal state.

9. The system of claim 7, wherein said counting invertor comprises a first opto-coupler for generating synchronizing signals to a clock terminal of said counter in response to said pulses.

10. The system of claim 7, wherein a voltage divider circuit is disposed between the output of said counter and said comparator, said voltage divider circuit for defining said voltage output.

11. The system of claim 8, wherein said counting invertor further comprises an opto-coupler disposed between said abnormal detection circuit and said microcomputer, said opto-coupler for informing said microcomputer of said abnormal state.

12. The system of claim 8, wherein said counting invertor further comprises an opto-coupler adapted to generate a second clearing signal to a clear terminal of said counter in response to a first clearing signal from said pulse generating means.

13. An electronic cooking system for heating foodstuff, comprising:

(a) a microcomputer for providing first signals and a second signal;

(b) a heating means for applying a direct current voltage to a heating coil;

(c) a driving circuit for controlling said heating means;

(d) a counting invertor having a counter and a comparator, said counter for counting said first signals and for providing a voltage output at a voltage level corresponding to the desired heating output of said heating coil, said comparator for comparing said voltage output and a sawtooth wave from an oscillator and for providing a pulsed output to said driving circuit; and (e) a pulse generating means disposed between said microcomputer and said counting invertor for synchronizing said counter and said microcomputer and for clearing said counter upon receipt of said second signal.

14. The system of claim 13, wherein said counting invertor further comprises an abnormal state detection circuit adapted to terminate said voltage output upon detection of an abnormal state of said heating means and adapted to generate a third signal to said microcomputer to inform said microcomputer of said abnormal state.

15. The system of claim 13, wherein a voltage divider circuit is disposed between the output of said counter and said comparator, said voltage divider circuit for defining said voltage output.

16. A method for a circuit of an electronic cooking system, the circuit having a microcomputer for providing pulses, a heating means for applying a direct current voltage to a heating coil, a driving circuit for controlling said heating means, a counting invertor having a counter and a comparator, said counter for counting said pulses and for providing a voltage output at a voltage level corresponding to the desired heating output of said heating coil, said comparator for comparing said voltage output and a sawtooth wave from an oscillator and for providing a pulsed output to said driving circuit, and a pulse generating means disposed between said microcomputer and said counting invertor for synchronizing said counter and said microcomputer, the method for controlling the direct current voltage to the heating coil comprising the steps of:

(1) counting the pulses from the microcomputer;

(2) generating the voltage output corresponding to the number of said pulses;

(3) comparing said voltage output with the sawtooth wave to thereby generate the pulsed output; and (4) controlling the direct current voltage to the heating coil in accordance with the pulsed output.

* * * * *